US011400513B2

(12) United States Patent
Harada et al.

(10) Patent No.: US 11,400,513 B2
(45) Date of Patent: Aug. 2, 2022

(54) CONTINUOUS CASTING FACILITY AND CONTINUOUS CASTING METHOD USED FOR THIN SLAB CASTING FOR STEEL

(71) Applicant: NIPPON STEEL CORPORATION, Tokyo (JP)

(72) Inventors: Hiroshi Harada, Tokyo (JP); Kanoko Yamamoto, Tokyo (JP); Takuya Takayama, Tokyo (JP); Keita Ikeda, Tokyo (JP); Yui Ito, Tokyo (JP)

(73) Assignee: NIPPON STEEL CORPORATION, Tokyo (JP)

( * ) Notice: Subject to any disclaimer, the term of this patent is extended or adjusted under 35 U.S.C. 154(b) by 0 days.

(21) Appl. No.: 15/734,351

(22) PCT Filed: Jun. 7, 2019

(86) PCT No.: PCT/JP2019/022730

§ 371 (c)(1),
(2) Date: Dec. 2, 2020

(87) PCT Pub. No.: WO2019/235615

PCT Pub. Date: Dec. 12, 2019

(65) Prior Publication Data

US 2021/0220907 A1 Jul. 22, 2021

(30) Foreign Application Priority Data

Jun. 7, 2018 (JP) ..... JP2018-109469

(51) Int. Cl.
*B22D 11/115* (2006.01)
*B22D 11/12* (2006.01)
*B22D 41/50* (2006.01)

(52) U.S. Cl.
CPC ..... *B22D 11/115* (2013.01); *B22D 11/122* (2013.01); *B22D 41/50* (2013.01)

(58) Field of Classification Search
CPC ..... B22D 11/115; B22D 11/122
See application file for complete search history.

(56) References Cited

U.S. PATENT DOCUMENTS 5,871,040 A * 2/1999 Kaseda ..... B22D 11/115 164/476
2005/0039876 A1* 2/2005 Eriksson ..... B22D 11/115 164/466

(Continued)

FOREIGN PATENT DOCUMENTS

EP 2 837 441 A1 2/2015
JP 2001-047196 A 2/2001

(Continued)

OTHER PUBLICATIONS

EPO machine translation of JP-2016007631-A (Year: 2016).*

(Continued)

*Primary Examiner* — Kevin E Yoon
(74) *Attorney, Agent, or Firm* — Myers Wolin, LLC.

(57) ABSTRACT

A continuous casting facility used for thin slab casting has a mold for casting molten steel, an immersion nozzle that supplies the molten steel into the mold, and an electromagnetic stirring device capable of providing a swirl flow at a molten steel surface in the mold, and a thickness $D_{Cu}$ (mm) of a copper plate of a long side wall, a thickness T (mm) of a steel piece, a frequency f (Hz) of the electromagnetic stirring device, electric conductivity σ (S/m) of the molten steel, and electric conductivity $\sigma_{Cu}$ (S/m) of the copper plate of the long side wall are adjusted to satisfy the following formulae (1)-a and (1)-b:

$$D_{Cu}<\sqrt{(2/\sigma_{Cu}\omega\mu)} \quad (1)\text{-a}$$

$$\sqrt{(1/2\sigma\omega\mu)}<T \quad (1)\text{-b},$$

(Continued)

where $\omega=2\pi f$: angular velocity (rad/sec), and $\mu=4\pi\times10^{-7}$: magnetic permeability in vacuum ($N/A^2$).

2 Claims, 8 Drawing Sheets

(56) References Cited

U.S. PATENT DOCUMENTS

| | | | | |
|---|---|---|---|---|
| 2011/0209847 | A1* | 9/2011 | Toh | B22D 11/115 164/504 |
| 2014/0190655 | A1 | 7/2014 | Toh et al. | |

FOREIGN PATENT DOCUMENTS

| | | | | |
|---|---|---|---|---|
| JP | 2001-047201 | A | | 2/2001 |
| JP | 2016-7631 | A | | 1/2016 |
| JP | 2016007631 | A | * | 1/2016 |
| JP | 2018-69324 | A | | 5/2018 |
| WO | 2013/069121 | A1 | | 5/2013 |
| WO | 2013/190799 | A1 | | 12/2013 |

OTHER PUBLICATIONS

Okano et al., "Relation between Large Inclusions and Growth Directions of Columnar Dendrites in Continuously Cast Slabs", Iron and Steel, vol. 61, p. 2982, 1975, Japan, with English abstract.

* cited by examiner

CONTINUOUS CASTING FACILITY AND CONTINUOUS CASTING METHOD USED FOR THIN SLAB CASTING FOR STEEL

CROSS-REFERENCE TO RELATED APPLICATION

This application is a national stage application of International Application No. PCT/JP2019/022730, filed on Jun. 7, 2019 and designated the U.S., which claims priority to Japanese Patent Application No. 2018-109469, filed on Jun. 7, 2018. The contents of each are herein incorporated by reference.

TECHNICAL FIELD

The present disclosure relates to a continuous casting facility and a continuous casting method used for thin slab casting for steel.

The present application claims priority based on Japanese Patent Application No. 2018-109469 filed in Japan on Jun. 7, 2018, and the content thereof is incorporated herein.

RELATED ART

A thin slab casting method is known for casting a thin slab (thin steel piece) having a slab thickness of 40 to 150 mm and further 40 to 100 mm. The cast thin slab is heated and then rolled by a small scale rolling mill with about 4 to 7 stages. As a continuous casting mold used for thin slab casting, a method using a funnel-shaped mold (funnel mold) and a method using a rectangular parallel mold are adopted. In continuous casting of a thin slab, it is necessary to secure productivity by high-speed casting, and industrially, high-speed casting of 5 to 6 m/min is possible, and a maximum casting speed is 10 m/min (see Non-Patent Document 1).

In the thin slab casting, as described above, the casting thickness is generally as thin as 150 mm or less, more generally 100 mm or less. On the other hand, the casting width is about 1.5 m, and the aspect ratio is high. Since the casting speed is as high as 5 m/min, throughput is also high. In addition, a funnel-shaped mold is often used for facilitating molten steel pouring into the mold, which makes a flow in the mold more complicated. Thus, in order to brake a nozzle discharge flow, a method (electromagnetic brake method) of placing an electromagnet on a long side of the mold to brake the flow has also been proposed (see Patent Document 1).

On the other hand, in general slab continuous casting that is not thin slab casting, an in-mold electromagnetic stirring device is used for the purpose of equalizing a molten steel temperature near a bath level, achieving uniform solidification, and in addition preventing inclusions from being trapped in a solidified shell. When the electromagnetic stirring device is used, it is necessary to stably form a swirl flow of molten steel within a horizontal cross section in the mold. Thus, conventionally, various technologies have been disclosed regarding a positional relationship between the electromagnetic stirring device and a bath level, a positional relationship between the electromagnetic stirring device and an immersion nozzle discharge hole through which molten steel is supplied into the mold from a tundish, and a relationship between a flow rate of the molten steel discharged from the nozzle and a stirring flow rate. For example, Patent Document 2 discloses a method of installing an immersion nozzle discharge hole at a position where a magnetic flux density in the immersion nozzle discharge hole is 50% or less of a maximum magnetic flux density of the electromagnetic stirring device.

Also in the thin slab casting, for the same purpose, if a swirl flow can be provided in a C cross section near the bath level, it is possible to equalize the molten steel temperature near the bath level, achieve uniform solidification, and also to prevent inclusions from being trapped in the solidified shell, and it can be said to be desirable. However, in the thin slab casting, in-mold electromagnetic stirring used in the general slab continuous casting is not used. This is probably because it is assumed that it is difficult to form the swirl flow because a mold thickness is thin and it is considered that a sufficient flow is provided in a solidified shell front surface because high-speed casting is already performed, and, in addition, if the swirl flow is provided near the bath level, in-mold flow becomes complicated, which is not unfavorable.

CITATION LIST

Patent Document

[Patent Document 1]
Japanese Unexamined Patent Application, First Publication No. 2001-47196
[Patent Document 2]
Japanese Unexamined Patent Application, First Publication No. 2001-47201

Non-Patent Document

[Non-Patent Document 1]
Fifth Edition Iron and Steel Handbook, Volume 1, Iron-making and Steel-making, pages 454-456
[Non-Patent Document 2]
Shinobu Okano et al., "Iron and Steel", 61 (1975), page 2982.

SUMMARY

Problems to be Solved

In the thin slab casting, since high-speed casting is performed while a steel piece thickness is thin, first, in order to brake the nozzle discharge flow and stabilize a level of the bath level, an electromagnetic brake is generally used, as described above. However, particularly in the thin slab casting, a gap between an immersion nozzle and the long side of the mold is narrowed, so that the flow of molten steel tends to become stagnant in this narrow gap. Also in the thin slab casting, it is preferable that the flow be secured between the immersion nozzle and the long side of the mold and a uniform swirl flow can be achieved over the entire level of the bath level. In general slab casting that is not thin slab casting, as described above, a method is widely used in which an electromagnetic stirring device (hereinafter, also referred to as EMS) is installed on a back side of a long side wall of the mold, and thrusts in opposite directions are applied on opposing long side walls to provide a stirring flow so as to form a swirl flow in a horizontal cross section near a meniscus in the mold.

By applying the above method, it is possible to realize a uniform molten steel temperature distribution near the bath level in the mold and a uniform thickness of the solidified shell, and also to prevent inclusions from being trapped in the solidified shell. Thus, first, also in the thin slab casting, it is preferable to form a swirl flow in the horizontal cross section near the meniscus in the mold. Next, as a flow rate of the stirring flow increases, the effect of equalizing the solidified shell thickness increases, so that it is preferable to provide a sufficient stirring flow. In particular, in thin slab casting of steel types such as hypoperitectic steel, which is likely to cause non-uniform solidification due to δ/γ transformation, a longitudinal crack is likely to be formed at a center of the long side of the mold due to a stagnation of the flow of molten steel in a narrow gap between the immersion nozzle and the long side of the mold, and it is important to provide a sufficient stirring flow.

When a swirl flow is formed in the mold, as shown in FIG. 2, at four corners in the mold, the pressure rises at a site where the stirring flow collides to bulge the bath level upwardly, and, on the contrary, a phenomenon in which the bath level (bath surface) is recessed occurs at a central portion in the thickness direction (hereinafter, also referred to as the thickness central portion) on a short side wall side of the mold. Specifically, as shown in FIG. 2(A), by providing the stirring flow such that the stirring flow swirls in the horizontal cross section by the EMS, a molten steel surface 7 bulges upwardly at the corner and sags at the thickness central portion on the short side wall side. A powder layer 18 exists on the molten steel surface 7.

In particular, when focusing on the short side wall where a distance between the corners is short and a gradient due to unevenness of the level of the bath level is large, as shown in FIG. 2(B), a solidified shell 19 is first formed at the corner, and at the thickness central portion, solidification starts later than the corner due to the unevenness of the level of the bath level. Thus, further downward in the mold, as shown in FIG. 2(C), solidification is delayed most at the thickness central portion, and a solidification delay portion 20 is formed.

An immersion nozzle 2 is provided with a discharge hole 3 extending in the long side direction of a mold 12, and when a discharge flow (hereinafter also referred to as the nozzle discharge flow 4) of molten steel is formed from the discharge hole 3, the flow rate at a thickness central portion is highest in the thickness direction of a steel piece. The nozzle discharge flow 4 collides with a short-side solidified shell. A solidification delay due to the nozzle discharge flow colliding with the short-side solidified shell is most remarkable at the thickness central portion in the thickness direction of the steel piece. In particular, in the casting of steel types such as hypoperitectic steel, which is likely to cause non-uniform solidification due to δ/γ transformation, a short-side thickness central portion is further floated up by a bending moment, and the solidification delay is accelerated. In addition, tensile stress acts at an interface to easily cause a crack under the skin.

From the above, as a result of unevenness of a shape of the level of the bath level formed by the stirring flow by the EMS, solidification is delayed, and in addition, the nozzle discharge flow collides. Therefore, an excessively large solidification delay portion is locally formed, and when the extent becomes remarkable, a breakout occurs. Such a phenomenon easily occurs because a distance between the immersion nozzle and the short side wall becomes shorter as the casting width becomes narrower.

From the above situation, in the thin slab casting, it is difficult to perform electromagnetic stirring that provides a swirl flow in the mold, and even if the electromagnetic stirring is performed, it is difficult to equalize the solidified shell, and especially, it is difficult to provide a stirring flow rate enough to prevent a longitudinal crack at the center of the long side of hypoperitectic steel.

The present disclosure has been made in view of the above circumstances, and an object of the present disclosure is to provide a continuous casting facility for steel and a continuous casting method for steel capable of preventing a longitudinal crack at a center of a long side of a steel piece in thin slab casting.

Means for Solving the Problem

The gist of the present disclosure is as follows.

(1) A first aspect of the present disclosure is a continuous casting facility used for thin slab casting for steel in which a steel piece thickness in a mold is 150 mm or less and a casting width is 2 m or less. The continuous casting facility for steel has a mold for casting molten steel that includes a pair of long side walls and a pair of short side walls that are each formed from a copper plate and are arranged opposite to each other, an immersion nozzle that supplies the molten steel into the mold, and an electromagnetic stirring device that is disposed along the long side wall on a back side of the pair of long side walls and provides a swirl flow on a molten steel surface in the mold. In this continuous casting facility, a thickness $D_{Cu}$ (mm) of the copper plate of the long side wall, a thickness T (mm) of the steel piece, a frequency f (Hz) of the electromagnetic stirring device, electric conductivity σ (S/m) of the molten steel, and electric conductivity $\sigma_{Cu}$ (S/m) of the copper plate of the long side wall are adjusted to satisfy the following formulae (1)-a and (1)-b:

$$D_{Cu}<\sqrt{(2/\sigma_{Cu}\omega\mu)} \quad (1)\text{-a}$$

$$\sqrt{(1/2\sigma\omega\mu)}<T \quad (1)\text{-b},$$

where $\omega=2\pi f$: angular velocity (rad/sec), and $\mu=4\pi\times10^{-7}$: magnetic permeability in vacuum ($N/A^2$).

(2) In the continuous casting facility for steel disclosed in (1) above, a flat cross-sectional shape of an inner surface of the short side wall is a curved shape projecting outside the mold at a meniscus position which is a position 100 mm below an upper end of the mold, and is a flat shape at a lower portion in the mold while a projecting amount of the curved shape gradually decreases toward a lower side in a casting direction, a formation range of the curved shape is a range from the meniscus position to a position equal to or lower than a lower end of the electromagnetic stirring device and upper than an immersion depth of the immersion nozzle, and a projecting amount δ (mm) at the meniscus position of the curved shape and the thickness T (mm) of the steel piece cast by the mold may satisfy a relationship of the following formula (2):

$$0.01\leq\delta/T\leq0.1 \quad (2).$$

(3) A second aspect of the present disclosure is a continuous casting method for steel using the continuous casting facility for steel disclosed in (1) or (2) above, and in the continuous casting method for steel, a thickness $D_{Cu}$ (mm) of the copper plate, a thickness T (mm) of the steel piece, a frequency f (Hz) of the electromagnetic stirring device, electric conductivity σ (S/m) of the molten steel, and electric conductivity $\sigma_{Cu}$ (S/m) of the copper plate are adjusted to satisfy the following formulae (1)-a and (1)-b:

$$D_{Cu}<\sqrt{(2/\sigma_{Cu}\omega\mu)} \quad (1)\text{-a}$$

$$\sqrt{(1/2\sigma\omega\mu)}<T \quad (1)\text{-b}$$

Here, $\omega=2\pi f$: angular velocity (rad/sec), μ: magnetic permeability of vacuum ($N/A^2$).

Effects

In the continuous casting facility and the continuous casting method used for thin slab casting for steel according to the present disclosure, the electromagnetic stirring device is installed in the mold in the thin slab casting, and, in addition, a frequency of an alternating current applied to the electromagnetic stirring device is optimized, so that the swirl flow is formed near a level of a bath level even in the thin slab casting in which a steel piece thickness is 150 mm or less. As a result, it is possible to achieve uniform solidification on a long side surface and prevent a longitudinal crack at a center of a long side of the steel piece.

When a flat cross-sectional shape of the inner surface of the short side wall is made into a curved shape and the formation range is defined, uniform solidification on the short side wall side can be achieved, and a shape of a solidified portion on the short side wall side can be made rectangular (flat shape). This eliminates a crack under the skin at a long-side width central portion and a center of short-side thickness, and further eliminates a breakout due to solidification delay near the center of the short-side thickness.

As a result, uniform solidification can be achieved while the swirl flow is provided near the bath level in the mold, and a casting speed can be increased, which is preferable.

BRIEF DESCRIPTION OF THE DRAWINGS

FIG. 2(A) is a partial side sectional view taken along the line A-A, FIG. 2(B) is a partial plan sectional view taken along the line B-B, and FIG. 2(C) is a partial plan sectional view taken along the line C-C.

FIG. 3(A) is a side sectional view taken along the line A-A, FIG. 3(B) is a plan sectional view taken along the line B-B, and FIG. 3(C) is a plan sectional view taken along the line C-C, and FIG. 3(D) is a plan sectional view taken along the line D-D.

DETAILED DESCRIPTION

Hereinafter, there will be described a continuous casting facility for a thin slab steel piece according to an embodiment of the present disclosure (hereinafter referred to as the continuous casting facility according to the present embodiment) in which a steel piece thickness in a mold is 150 mm or less. The steel piece thickness may be more than 100 mm.

Figure 1:
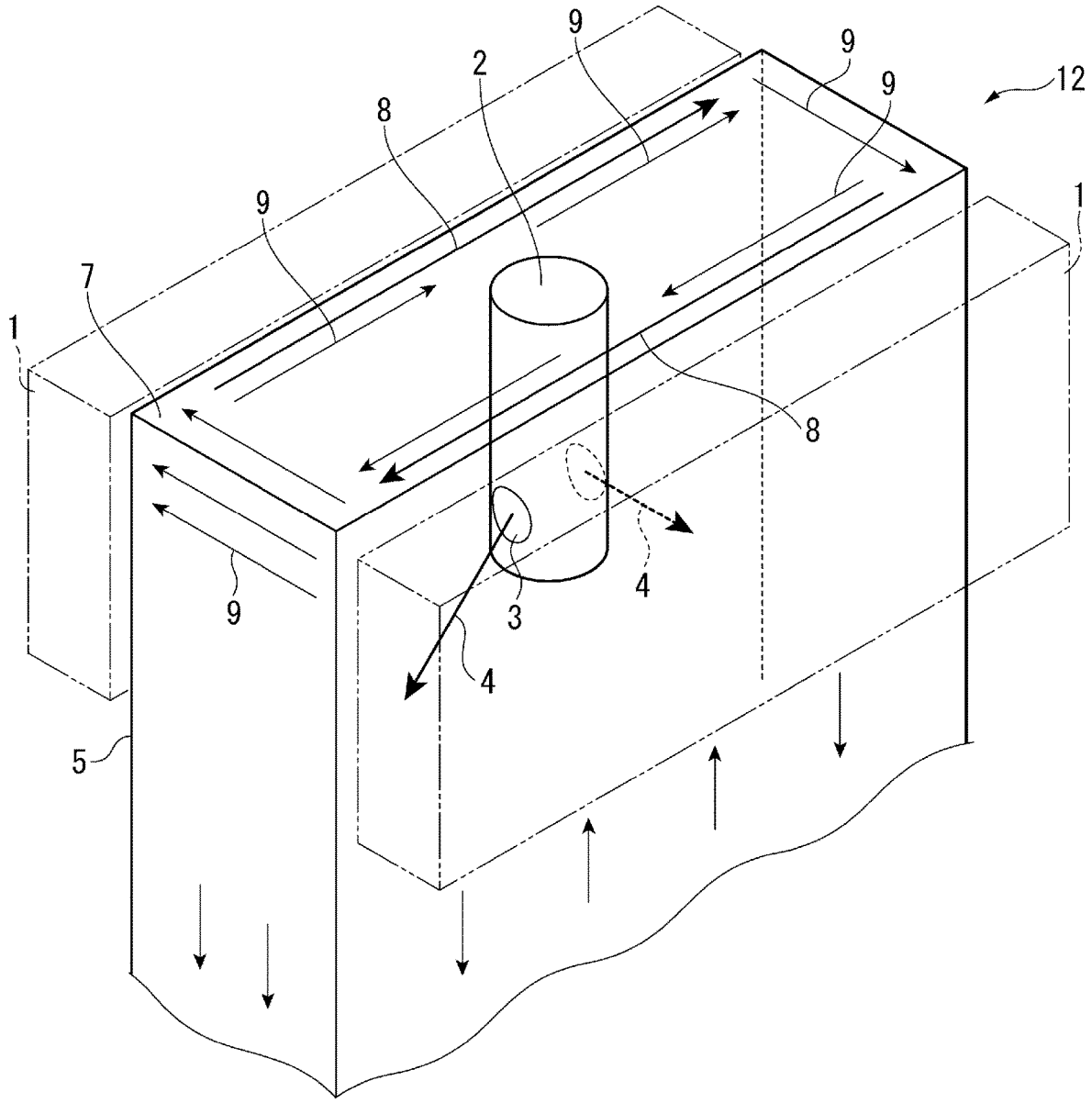
FIG. 1 is a perspective conceptual diagram for explaining a molten steel flow in a mold by electromagnetic stirring.

The continuous casting facility according to the present embodiment is a facility having a mold 12 for casting molten steel that includes a pair of long side walls and a pair of short side walls that are each formed from a copper plate and are arranged opposite to each other, an immersion nozzle 2 that supplies molten steel 6 in the mold, and an electromagnetic stirring device 1 that is disposed along the long side wall on a back side of the pair of long side walls and provides a swirl flow 9 for molten steel near a molten steel surface 7 (hereinafter, also referred to as the bath level) in the mold. FIG. 1 shows a schematic diagram of a molten steel flow in the mold when EMS is applied. In FIG. 1, the long side wall and the short side wall of the mold 12 are not shown for easy understanding, and a casting space 5 surrounded by the long side wall and the short side wall is shown. Since the molten steel surface 7 in the mold is usually cast around 100 mm apart from an upper end of the mold, a position 100 mm below the upper end of the mold is referred to as a meniscus position P1 in the following description.

Figure 2:
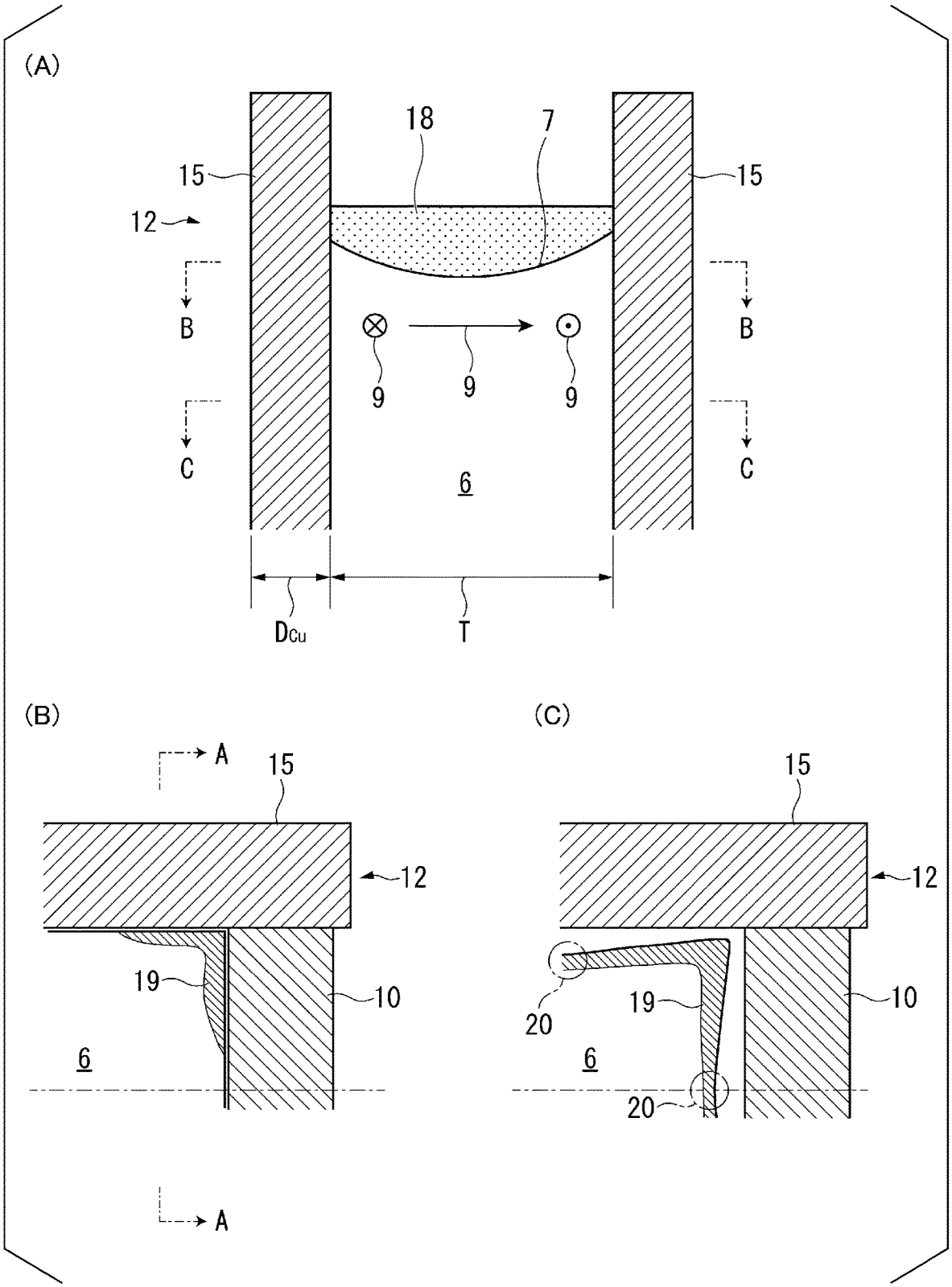
FIG. 2 is a conceptual diagram showing a shape of molten steel surface and an initial solidification state in the mold by electromagnetic stirring, where

The continuous casting facility according to the present embodiment has the following configuration (a). Configuration (a): a copper plate thickness $D_{Cu}$ of a mold long side wall 15 shown in FIG. 2(A), a steel piece thickness T in the mold, and a frequency f of an alternating current applied to the electromagnetic stirring device satisfy a predetermined relational expression.

By the configuration (a), it is possible to form a stirring flow at a meniscus portion even in thin slab casting in which the steel piece thickness in the mold is 150 mm or less.

The continuous casting facility preferably further has the following configurations (b) and (c).

Figure 3:
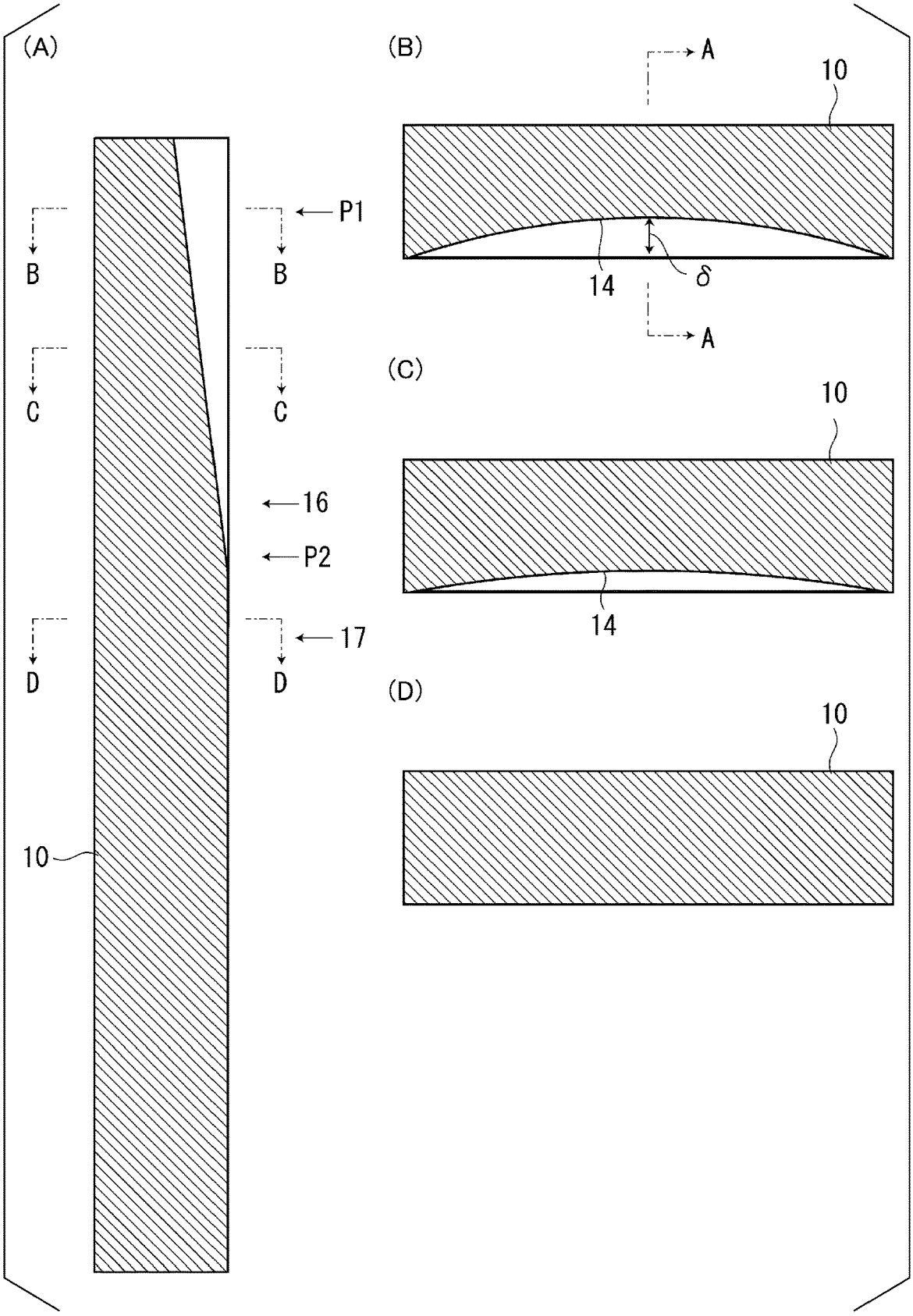
FIG. 3 is a view showing a curved shape formed on a short side wall, where

Configuration (b): a flat cross-sectional shape of an inner surface (hereinafter, also referred to as the inner surface shape) of a short side wall 10 is a curved shape projecting outside the mold near the meniscus position P1, as shown in FIG. 3, and is a flat shape at a lower portion (other than the curved shape) while a projecting amount of the curved shape is gradually reduced (narrowed down) toward a lower side in the casting direction. The portion projecting so as to form a curved shape is a concave portion when viewed from the mold 12, and is therefore also referred to as a recess 14.

Configuration (c): a formation range of the curved shape is a range from the meniscus position P1 to a position P2 equal to or lower than a lower end 16 (lower end position of a core (iron core)) of the electromagnetic stirring device and upper than an immersion depth 17 of the immersion nozzle. The immersion depth 17 of the immersion nozzle is a depth (for example, about 200 to 350 mm) of a lower end position of the discharge hole 3, and the lower end position of the discharge hole 3 of the immersion nozzle is lower than the lower end 16 of the electromagnetic stirring device.

When the continuous casting facility has the configurations (b) and (c), uniform solidification on the short side wall side can be achieved, and a shape of a solidified portion on the short side wall side can be made rectangular (flat shape). This eliminates a crack under the skin at a long-side width central portion and a center of short-side thickness, and further eliminates a breakout due to solidification delay near the center of the short-side thickness.

The configuration (a) will be described below.

The present inventors have studied conditions for forming a stirring flow at a molten steel surface portion in the mold in the thin slab casting in which the steel piece thickness is 150 mm or less.

For that purpose, first, it is important that a skin depth of an alternating magnetic field formed by the electromagnetic stirring device 1 be larger than the copper plate thickness $D_{Cu}$ of the mold long side wall 15. This condition is defined by the following formula (1)-a. That is, the skin depth of the electromagnetic field in a conductor needs to be larger than the copper plate thickness $D_{Cu}$.

$$D_{Cu}<\sqrt{(2/\sigma_{Cu}\omega\mu)} \quad (1)\text{-a}$$

Conventionally, in the thin slab casting in which the steel piece thickness T is 150 mm or less, it has not been possible to form a swirl flow in the molten steel in the mold even if an electromagnetic stirring thrust has been applied so that a swirl flow has been formed in the mold. On the other hand, the inventors of the present disclosure have first found that in order to prevent the electromagnetic fields formed in the mold by the electromagnetic stirring device, installed on the respective back sides of the two long side walls 15 facing each other, from interfering with each other, the frequency is set so that the skin depth of an electromagnetic force to be formed in molten steel by the electromagnetic stirring device is smaller than the steel piece thickness T, so that the swirl flow is formed in a level of the bath level. This condition is defined by formula (1)-b. This formula shows a relationship between the skin depth of the electromagnetic force and the steel piece thickness, and the skin depth of the electromagnetic force is defined by half the skin depth of the electromagnetic field in the conductor. This is because, although the electromagnetic force is a current density×a magnetic flux density, penetration of the current density and magnetic field into the conductor is described by $\sqrt{(2/\sigma\omega\mu)}$, so that the skin depth of the electromagnetic force of the product is $1/2\times\sqrt{(2/\sigma\omega\mu)}$, which is described by $\sqrt{(1/2\sigma\omega\mu)}$.

$$\sqrt{(1/2\sigma\omega\mu)}<T \quad (1)\text{-b}$$

In the above formulae (1)-a and (1)-b, $\omega=2\pi f$: angular velocity (rad/sec), $\mu$: magnetic permeability in vacuum ($N/A^2$), $D_{Cu}$: mold copper plate thickness (mm), T: steel piece thickness (mm), f: frequency (Hz), $\sigma$: electric conductivity of molten steel (S/m), and $\sigma_{Cu}$: copper plate electric conductivity (S/m).

By performing electromagnetic stirring at a high frequency as specified by the formula (1)-b, for the first time, in the thin slab casting in which the steel piece thickness is 150 mm or less, it becomes possible to form a swirl flow with a sufficient flow rate in the mold. In conventional in-mold electromagnetic stirring, it is common to use a low frequency in order to reduce energy loss in a mold copper plate.

The electric conductivity of the molten steel and the electric conductivity of the copper plate may be measured using a commercially available electric conductivity meter.

Figure 4:
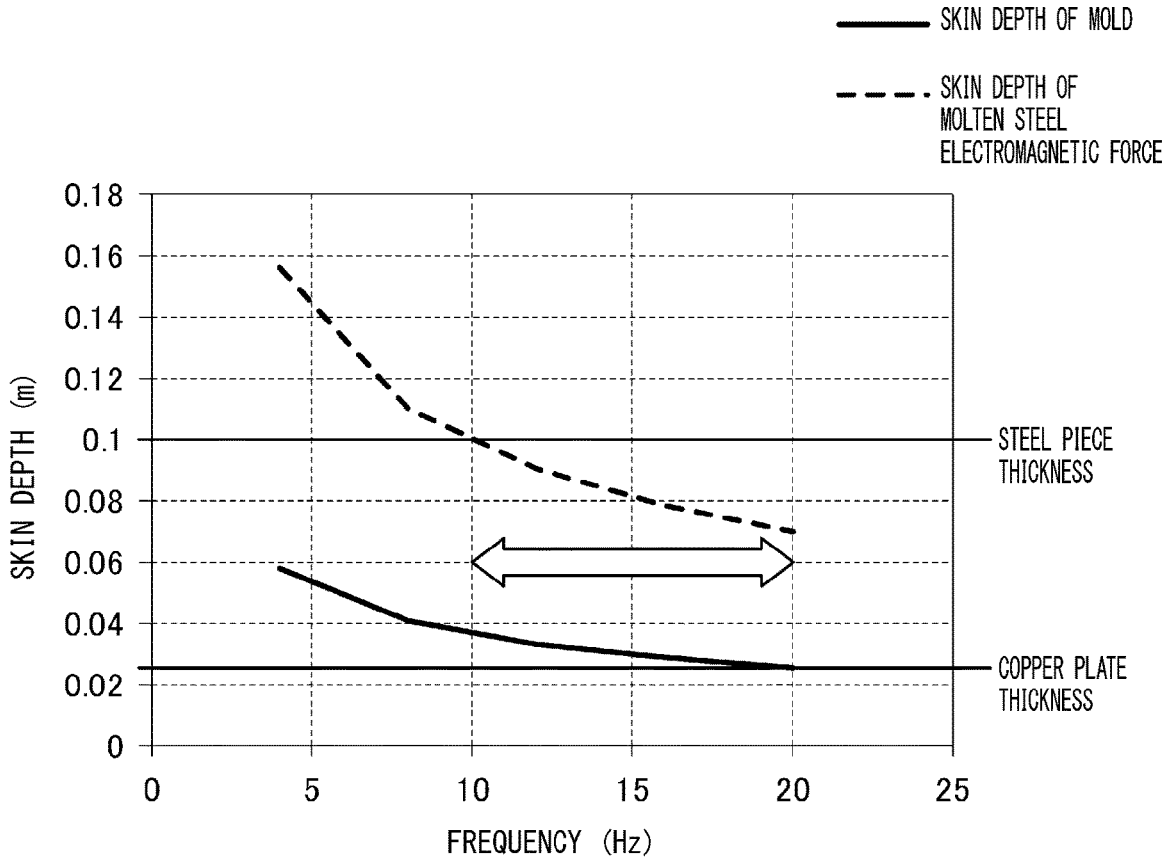
FIG. 4 is a graph showing an influence of an electromagnetic stirring frequency on a skin depth of the mold and a skin depth of a molten steel electromagnetic force.

FIG. 4 shows an example of an influence of an electromagnetic stirring frequency on the skin depth of the mold and a skin depth of a molten steel electromagnetic force. When a long-side wall copper plate thickness is 25 mm, if an electromagnetic stirring frequency f is made smaller than 20 Hz, the formula (1)-a can be satisfied. When an in-mold steel piece thickness T is 100 mm, if the electromagnetic stirring frequency f is made larger than 10 Hz, the formula (1)-b can be satisfied.

Thus, the electromagnetic stirring device is installed in the mold in the thin slab casting, and, in addition, the frequency of the alternating current applied to the electromagnetic stirring device is optimized, so that the swirl flow is formed near the level of the bath level even in the thin slab casting in which the steel piece thickness is 150 mm or less. As a result, it is possible to achieve uniform solidification on a long side surface and prevent a longitudinal crack at a center of a long side of the steel piece.

Next, the configuration (b) will be described.

The present inventors have studied a method of achieving uniform solidification near the short side wall under the flow of molten steel obtained by applying the EMS.

First, it has been considered that by adopting the above configuration (b) as the configuration of the short side wall of the mold:

1) solidification shrinkage in each direction of the long side wall and the short side wall may be compensated, 2) the configuration of the mold itself may follow a change in shape near a corner, and 3) a pressure rise at the corner due to collision of the stirring flow may be mitigated.

Thus, a mold having a different inner surface shape of the short side wall 10 was produced, casting was performed using the mold, and an influence of an internal shape of the short side wall 10 on the shape of the steel piece was investigated.

In the investigation, 0.1% C steel (hypoperitectic steel) was produced by refining in a converter, treatment in a reflux type vacuum degassing device, and addition of an alloy. Then, a steel piece having a width of 1200 mm and a thickness of 150 mm was cast at a casting speed of 5 m/min. A position of the molten steel surface in the mold was 100 mm apart from the upper end of the mold.

Here, casting was performed using a continuous casting facility equipped with the electromagnetic stirring device 1 (EMS) on the back side of the long side wall 15 for the purpose of forming the swirl flow in a horizontal cross section near the meniscus. The EMS was installed so that an upper end of an EMS core coincided with the meniscus position P1 (100 mm apart from the upper end of the mold) in the mold. A core thickness of the EMS is 200 mm, and the lower end 16 of the electromagnetic stirring device is 200 mm apart from the meniscus position. The immersion depth 17 of the immersion nozzle was 250 mm apart from the meniscus position P1. Casting was performed under the same conditions, without using the electromagnetic stirring device.

Figure 5:
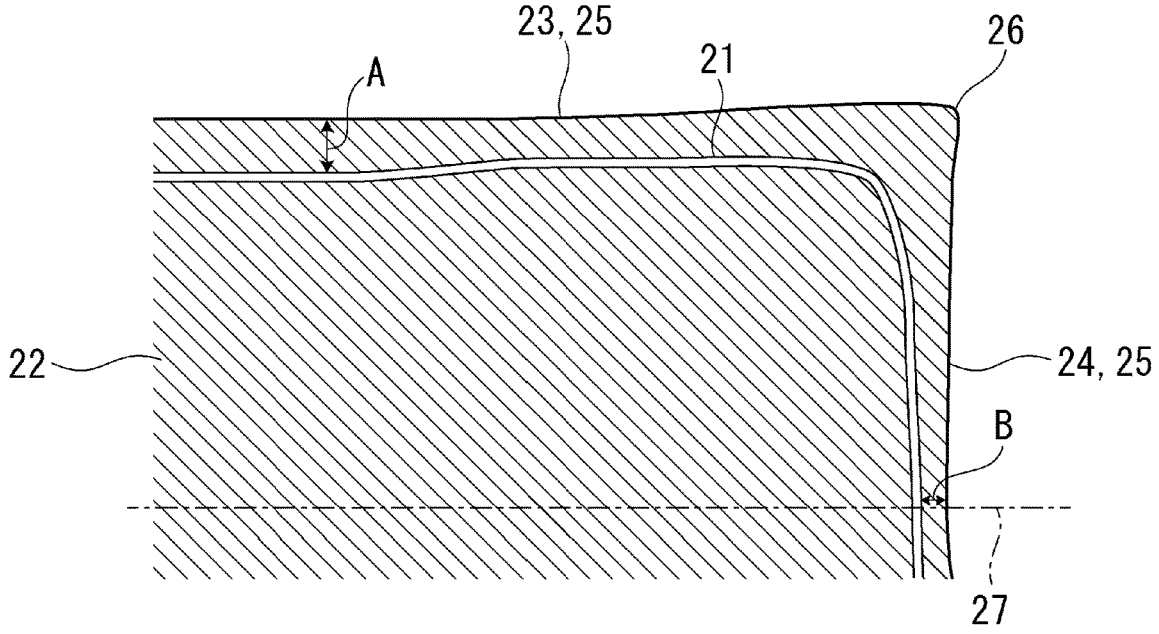
FIG. 5 is a diagram illustrating a white band observed on a cross section of a steel piece.

A sample was cut out from the cast steel piece, and a solidification structure of a short side portion was investigated. As shown in FIG. 5, a linear negative segregation line called a white band 21 and indicating a solidified shell front at a certain moment is observed on the cross section of the steel piece. This occurs because a molten steel flow hits the solidified shell and concentrated molten steel on a front surface of the solidified shell is washed away. Therefore, a thickness from a surface 25 of a steel piece 22 to the white band 21 represents a thickness of the solidified shell at a position where the molten steel flow collides. Thus, in a region toward a width center from a corner 26 on a long side 23 side of the steel piece 22, a thickness A of a site where a thickness from the surface 25 to the white band 21 is substantially constant and a thickness B of a thinnest portion of a thickness center 27 of a short side 24 were measured, and a ratio of the thickness A and the thickness B, that is, B/A was defined as solidification uniformity. If the solidification uniformity is 0.7 or more, no crack under the skin is observed, so that 0.7 was set as a judgment condition.

A magnitude of mold resistance was evaluated by comparing a measured oscillation current value with the oscillation current value when sticking breakout occurred.

The experimental results will be described below.

First, several molds having different materials and thicknesses in the mold copper plates were produced, and casting was performed under a condition that the frequency f of the alternating current applied to the electromagnetic stirring device 1 was different. In a width central portion of the cast steel piece, the solidification structure was investigated, an inclination angle of dendrite growing inward from a steel piece surface, that is, an angle with respect to a perpendicular of a long side surface was measured, and its inclination direction was investigated. Based on Non-Patent Document 2, the flow rate and flow direction of the molten steel at the site were evaluated from the inclination angle and the inclination direction of the dendrite. As a result, it was found that a favorable swirl flow was formed at the meniscus portion as long as the conditions satisfied the following relationship between the frequency f of the alternating current flowing in the electromagnetic stirring device 1, electric conductivity $\sigma_{Cu}$ (S/m) of the mold copper plate, the copper plate thickness $D_{Cu}$ (S/m), and the thickness T (mm) of the steel piece.

$$D_{Cu}<\sqrt{(2/\sigma_{Cu}\omega\mu)} \quad (1)\text{-a}$$

$$\sqrt{(1/2\sigma\omega\mu)}<T \quad (1)\text{-b},$$

where $\omega=2\pi f$: angular velocity (rad/sec), $\mu$: magnetic permeability in vacuum ($N/A^2$), and $\sigma$: electric conductivity of molten steel (S/m).

It was also found that as long as the conditions satisfy the above formulae (1)-a and (1)-b, the flow rate of the stirring flow on the bath level of 20 cm/sec could be secured by adjusting thrust 8 of the electromagnetic stirring.

Next, after the short side wall 10 was provided with a curved shape as shown in FIG. 3, and an influence of a curved projecting on the solidification uniformity and the mold resistance was examined. The formation range of the curved shape is a range from the meniscus position P1 (100 mm position from the upper end of the mold) to the position P2 shown in FIG. 3. Of course, the curved shape is continuously formed from the meniscus position P1 to the upper end of the mold as shown in FIG. 3. During casting, the level of the bath level in the mold is adjusted so that the meniscus position P1 is at the level of the bath level (molten steel surface 7). The conditions of the electromagnetic stirring were those satisfying the above formulae (1)-a and (1)-b, and the thrust of the electromagnetic stirring was adjusted so that the flow rate of the stirring flow on the bath level was 30 cm/sec.

First, the lower end position P2 of the formation range of the curved shape was set to 200 mm in the casting direction from the level of the bath level (meniscus position P1). The lower end position P2 is equal to the lower end 16 of the electromagnetic stirring device and is located above the immersion depth 17 of the immersion nozzle. Then, a projecting amount $\delta$ at the meniscus position P1 was changed to 0 to 15 mm, and B/A in FIG. 5 described above was used as the solidification uniformity to evaluate the influence of the steel piece on the solidification uniformity.

Figure 6:
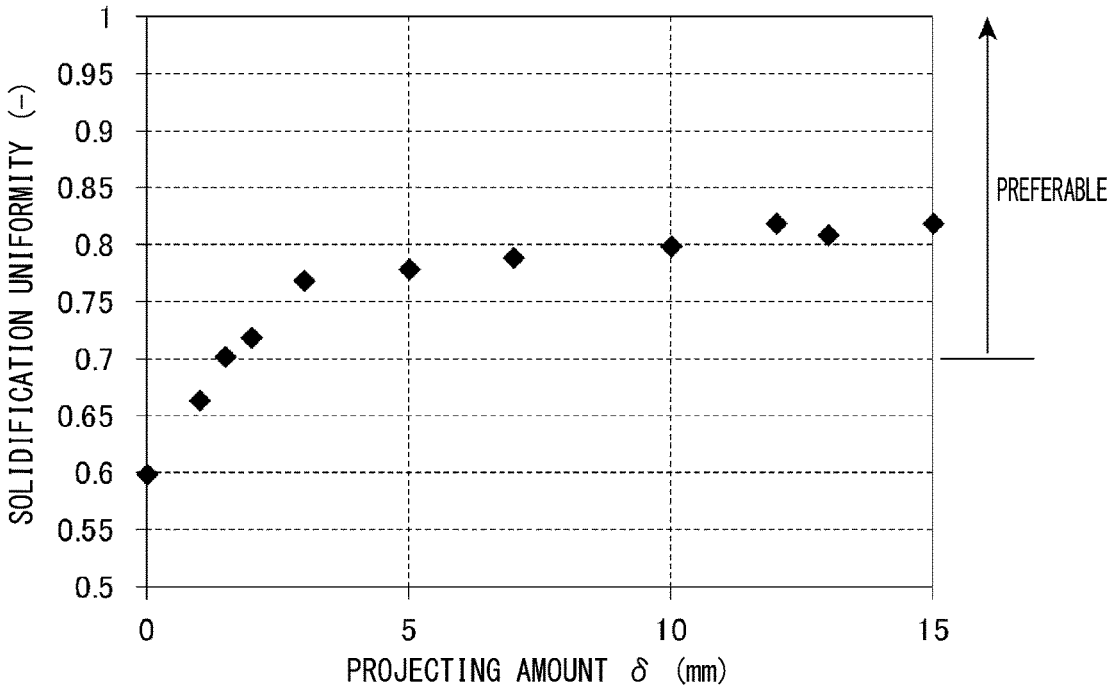
FIG. 6 is a graph showing a relationship between a projecting amount δ of the curved shape of the short side wall and solidification uniformity.

The results are shown in FIG. 6. When the EMS was not used, the solidification uniformity was 0 to 0.3, and there were times when casting was interrupted due to breakout. However, under the conditions satisfying the above formulae (1)-a and (1)-b, even if the projecting amount $\delta$ at the meniscus position P1 was 0, the solidification delay at the center of the short-side thickness was eliminated, and the solidification uniformity was greatly improved to 0.6.

In addition, when the projecting amount $\delta$=1 mm, the solidification uniformity was 0.66. When 6=1.5 mm, the solidification uniformity was 0.70. When 6=2 mm, the solidification uniformity was 0.72. Therefore, if the projecting amount $\delta$ is set to 1.5 mm or more, it can be said that the effect that no crack under the skin is observed even in 0.1% C steel (hypoperitectic steel) and the solidification uniformity of 0.7 or more is achieved has been recognized. When the projecting amount $\delta$ exceeded 15 mm ($\Delta$/T=0.1), the mold resistance tended to increase. That is, when 6/T was in a range of 0.01 to 0.1, the solidification uniformity was further improved, and no increase in mold resistance was observed.

Although this result is obtained when the thickness T of the steel piece was set to 150 mm, it was also found that as a result of experiments with various thickness changes, the projecting amount $\delta$ (mm) required at the meniscus position P1 was proportional to the thickness T (mm) of the steel piece cast in the mold. This relational expression is shown as formula (2).

$$0.01\leq\delta/T\leq0.1 \quad (2).$$

Figure 7:
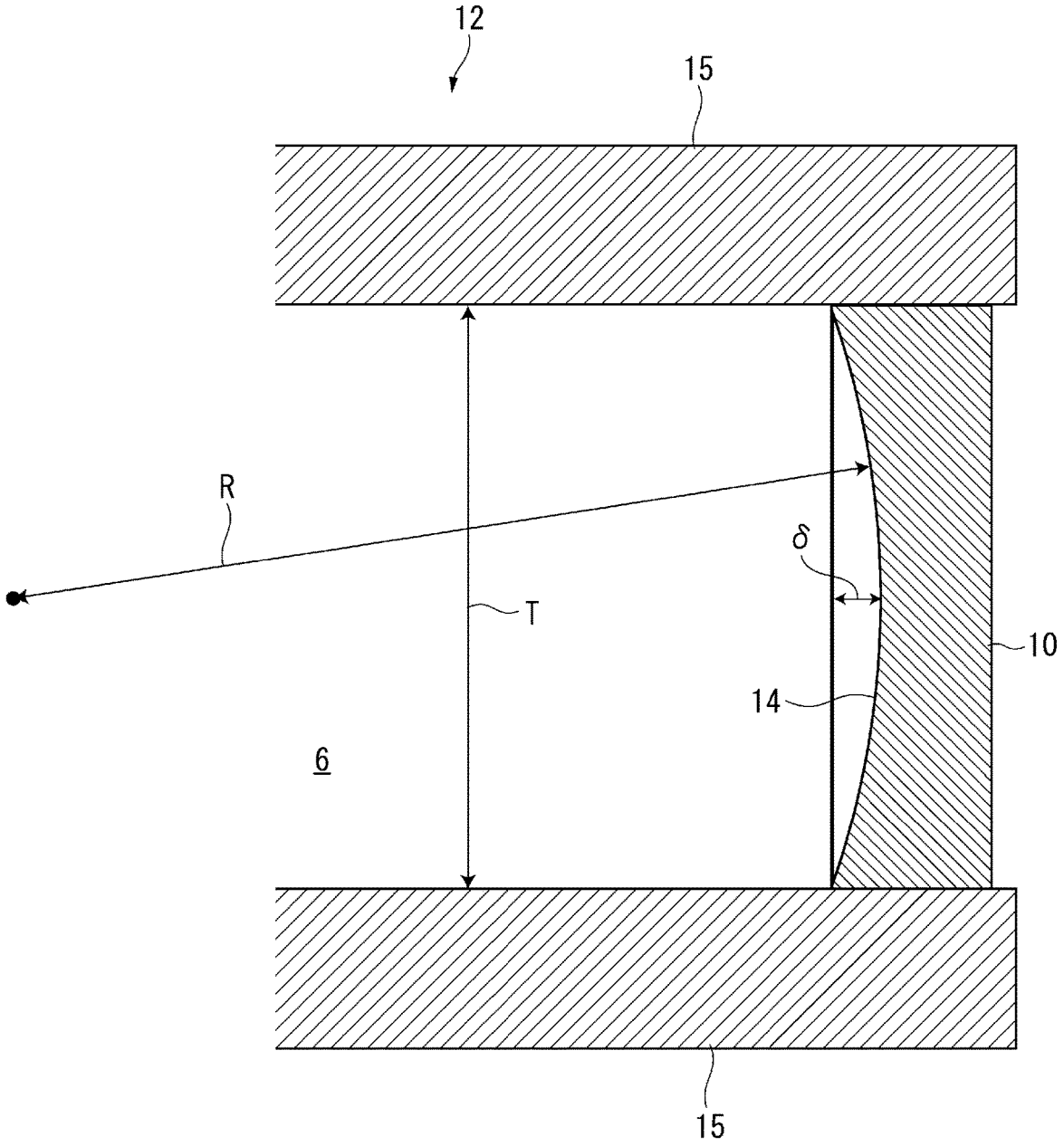
FIG. 7 is a diagram showing a radius of curvature R of the curved shape that is an arc and the projecting amount δ.

As the curved shape formed on the short side wall 10, the flat cross-sectional shape can be selected from an arc shape, an elliptical shape, a sine curve, and any other curved shape. For example, when an arc shape is adopted, based on the schematic diagram shown in FIG. 7, when the inner surface shape of the short side wall is a gently curved shape so as to project to the outside of the mold near the meniscus, and the result of the above formula (2), that is, $\delta$/T at the meniscus position P1 is represented by the radius of curvature R (mm) of the curved shape and the thickness T (mm) of the steel piece, a relationship of the following formula (3) is obtained.

$$\delta/T=R/T-(\sqrt{(4R^2-T^2)})/(2T) \quad (3)$$

Figure 8:
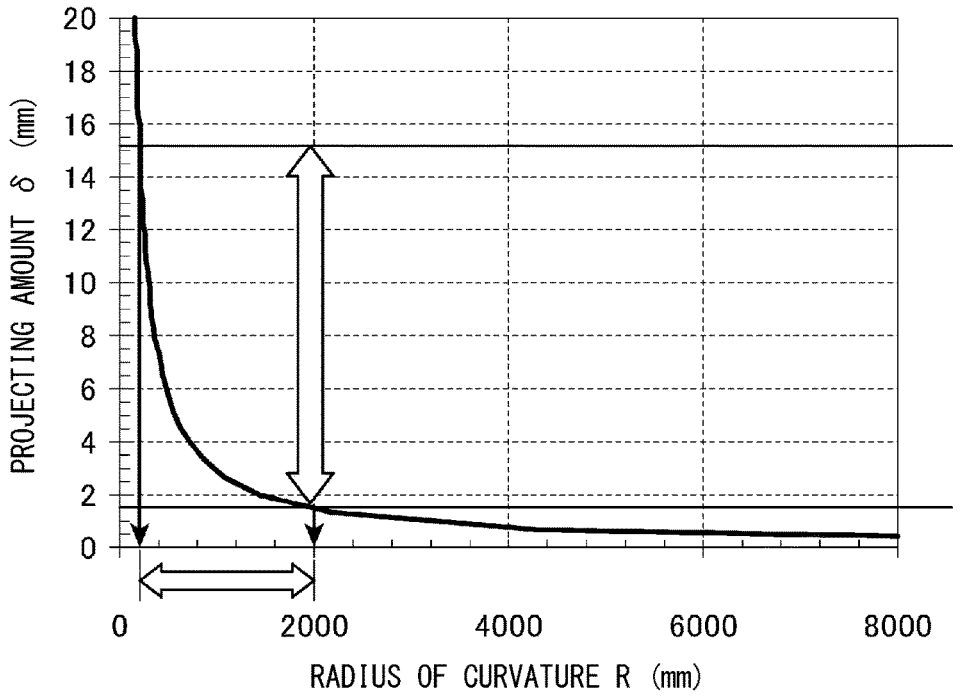
FIG. 8 is a graph showing a relationship between the radius of curvature R of the curved shape that is an arc and the projecting amount S.

FIG. 8 is a result (relationship between the radius of curvature R and the projecting amount $\delta$) obtained by setting the thickness T of the steel piece to 150 mm by using the above formula (3), and it was found that the above formula (2) was satisfied within a range indicated by ↔ (white double-headed arrow) in FIG. 8, and a high solidification uniformity was obtained.

Here, the reason why high solidification uniformity is obtained by the configuration (b) described above is summarized as follows.

1) When the inner surface of the short side wall is curved, an inner surface length of the short side wall in plan view cross-section changes (increases) substantially, so that the same effect as that obtained when the long side wall is tapered near the meniscus is obtained.

2) As for the shape of the corner, the angle of the meniscus is made obtuse or more than 90 degrees, so that a pressure rise at the corner is moderated, and a bulging amount itself becomes small.

3) The mold changes the shape of the short side from an R shape to a flat shape so as to squeeze the entire short side in the casting direction with respect to the steel piece. Thus, the molten steel bulges upwardly due to the EMS and sags at a short-side thickness central portion, so that this is effective for achieving uniform solidification of the short-side thickness central portion in which solidification delay is likely to occur.

Figure 9:
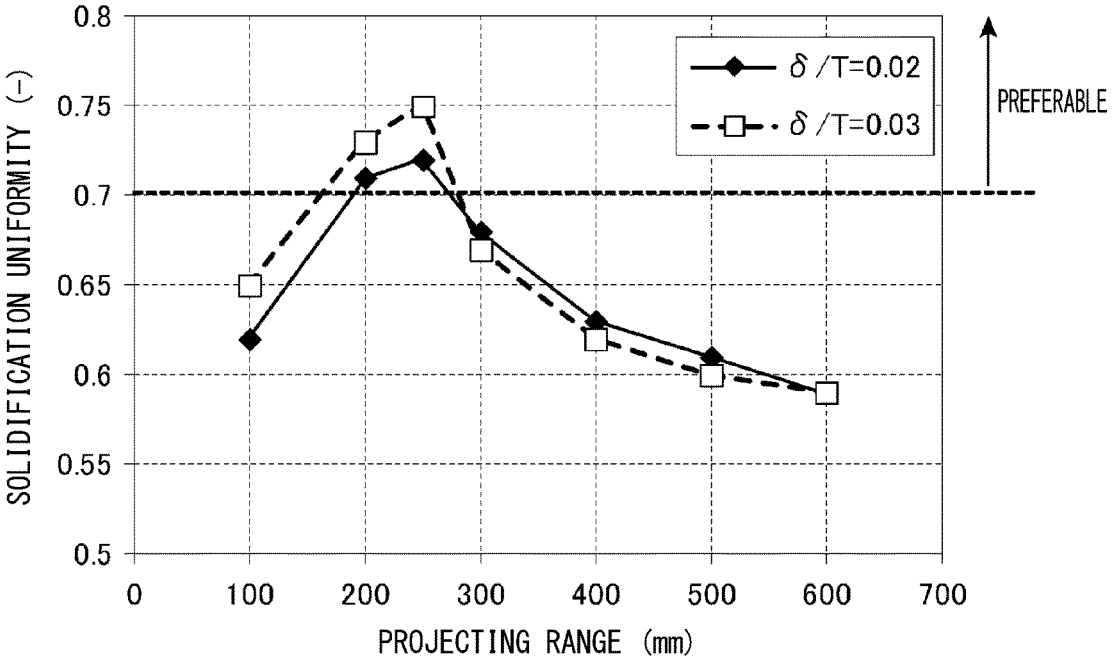
FIG. 9 is a graph showing a relationship between a curved shape formation range (projecting range) in a height direction and the solidification uniformity.

When a curved projecting is formed on the short side wall, the formation range (lower end position P2) was varied in the casting direction, and a test was performed. The results are shown in FIG. 9. A projecting range of a horizontal axis is the distance from the meniscus position P1 to the lower end position P2 of the curved shape.

In this casting test, the upper end of the core of the EMS is the meniscus position P1, and a thickness in the height direction of the core (hereinafter also referred to as the core thickness) is 200 mm, so that the lower end 16 of the electromagnetic stirring device is located at 200 mm apart from the meniscus position P1. If the lower end position P2 of a region (formation range) where the projecting is provided was equal to or lower than the lower end 16 of the electromagnetic stirring device, an improvement effect by providing the projecting was obtained. However, when the formation range of the projecting was 100 mm, which was shorter than the core thickness of the EMS, the improvement of the solidification uniformity was insufficient. On the other hand, when the formation range of the projecting was longer than the core thickness of the EMS and longer than 250 mm which was the immersion depth 17 of the immersion nozzle, the effect became small.

Therefore, a preferred configuration of the short side wall of the mold also includes the above configuration (c).

Next, the result of examining the influence of the flow rate of the stirring flow on the meniscus will be described.

In this case, a current value of the EMS was changed, a molten steel flow rate in the meniscus was assigned to 1 m/sec, and a test was performed. The molten steel flow rate was calculated from a dendrite inclination angle of the cross section of the steel piece as described above. As a result, including the condition that the EMS was not applied, up to a molten steel flow rate of 60 cm/sec in the meniscus, an improvement effect of achievement of uniform solidification was obtained under the above conditions. However, when the molten steel flow rate exceeded 60 cm/sec, uniform solidification could not be achieved only by changing an inner surface shape of the mold.

As for the minimum value of the molten steel flow rate, when the molten steel flow rate of 20 cm/sec or more was provided, and more preferably, the molten steel flow rate of about 30 cm/sec was provided, uniform solidification could be achieved.

When the flow rate of the meniscus was 60 cm/sec, a bulging height of the corner in the meniscus had a difference of 30 mm from the thickness central portion on the short side wall side. Thus, it can be said that an application range of the continuous casting facility for steel of the present disclosure is a range where the flow rate of the meniscus is 60 cm/sec or less (particularly, the lower limit is 10 cm/sec), and the bulge height on the short side wall side is 30 mm or less.

A method of setting a taper value of the short side wall forming the curved projecting will be described below.

The short side wall is assumed to have a single taper. Thus, with reference to the corner when no projecting is formed, according to a taper rate selected under each casting condition, a set angle of the short side wall may be changed, and an upper end width and a lower end width of the mold may be set. At that time, the formation range of the projecting may be set so as to fall within a range from the meniscus position P1 to the position P2 that is equal to or more than the core thickness of the EMS and is higher than the immersion depth of the immersion nozzle. In addition, it is preferable to adjust the ratio $\delta/T$ of the projecting amount $\delta$ (mm) at the meniscus position P1 and the thickness T (mm) of the steel piece to 0.01 or more and 0.1 or less (that is, the formula (2) described above).

Even if $\delta/T$ is 0.1, when a ratio of a length of an arc formed by the inner surface of the short side wall in the meniscus to a length of a lower flat portion is taken, $\delta/T$ is obviously smaller than an amount of solidification shrinkage. Thus, the steel piece is not restricted in a region of the projecting, and uniform solidification can be achieved.

Since the immersion depth of the immersion nozzle is usually 50 to 150 mm apart from a core lower end of the EMS, it is preferable to set a lower end position of a short side projecting to a position from the core lower end position of the EMS or the core lower end up to 150 mm.

Although a size of the mold can be variously changed according to the size of the steel piece (slab) to be cast, for example, the size is a size capable of casting the slab having a thickness (interval between the long side walls facing each other) of about 100 to 150 mm and a width (interval between the short side walls facing each other) of about 1000 to 2000 mm.

Since uniform solidification can be achieved by the continuous casting facility according to the present embodiment, the casting speed can be increased, so that the continuous casting facility according to the present embodiment is preferably applied to casting in which the casting speed is 3 m/min or more. Although the upper limit value is not specified, the currently possible upper limit value is, for example, about 6 m/min.

As described above, even under a condition that the stirring flow is provided such that the swirl flow is formed near the bath level, that is, a condition that the bath level bulges upwardly at the corner and sags at the thickness central portion, the solidification delay at the short-side thickness central portion can be prevented by using the mold of the continuous casting facility according to the present embodiment, and solidification proceeds uniformly.

In addition, in the lower portion where the influence of the stirring flow disappears, uniform solidification can be achieved by squeezing uniformly in the thickness direction by a usual taper. As a result, the shape of the short side wall may be linear, and the solidification delay at the short-side thickness central portion can be eliminated.

In addition, when the inner surface shape of the short side wall is a curved shape, it is possible to obtain the effect of relieving the pressure when the swirl flow collides with the corner. Thus, there is also an effect of reducing unevenness of a shape of the bath level on the short side wall side.

EXAMPLES

Next, examples which were performed so as to confirm the action effects of the present disclosure will be described.

0.1% C steel (hypoperitectic steel) was produced by refining in a converter, treatment in a reflux type vacuum degassing device, and addition of an alloy. Then, the molten steel was cast into a slab having a width of 1800 mm and a thickness of 150 mm.

First, the conditions for forming the stirring flow at the meniscus portion were examined. Thus, casting was performed using a continuous casting facility equipped with the EMS on the back side of the long side wall under a condition that the stirring flow was formed by the EMS so as to swirl in the horizontal cross section near the meniscus. The material of the mold copper plate was ES40A, the mold copper plate thickness $D_{Cu}$ was 25 mm, current passage is performed under a condition that the frequency f of the alternating magnetic field flowing in the electromagnetic stirring device was changed, and casting was performed. The electric conductivity of the molten steel $\sigma=6.5\times10^5$ S/m, the electric conductivity of the copper plate $\sigma_{Cu}=1.9\times10^7$ S/m, and the magnetic permeability in vacuum $\mu=4\pi\times10^{-7}$ N/A$^2$. A C-section solidification structure of the steel piece was sampled, the dendrite inclination angle at the width central portion was measured, and the stirring flow rate was estimated from the inclination angle using the formula of Okano et al described in Non-Patent Document 2. The right side of the formula (1)-a was the skin depth of the mold, and the left side of the formula (1)-b was the skin depth of the electromagnetic force. The results are shown in Table 1.

Regarding the evaluation of the longitudinal crack at a center in the width direction of the long side of the steel piece, the steel piece surface was observed visually, and presence of a crack with a dent substantially parallel to the casting direction or a dent was investigated. In addition, regarding a site where a dent was observed, a sample was cut out. After polishing, a solidification structure was portrayed with picric acid, and presence of a crack accompanied by segregation of P or the like under the skin was investigated. When the crack accompanied by the segregation of P or the like was found under the skin, it was evaluated as "presence" of the longitudinal crack, and when no crack was found, it was evaluated as "absence". As a result, in Invention Examples A2 to A5 in Table 1, no longitudinal crack was observed at the center in the width direction of the long side. On the other hand, in Comparative Examples A1 and A6, although improvement was obtained as compared with the condition where EMS was not applied, when a detailed observation was performed, the longitudinal crack was observed at the center in the width direction of the long side.

As in Invention Examples A2 to A5 in Table 1, when the frequency was set (satisfying the formula (1)-b) so that the skin depth of the mold was larger than the mold copper plate thickness (satisfying the formula (1)-a) and the skin depth of the electromagnetic force was smaller than the steel piece thickness, the molten steel flow rate was 20 cm/sec or more, and it was found that the swirl flow was efficiently formed at the level of the bath level. Thus, as for the minimum value of the molten steel flow rate, in Comparative Examples A1 and A6 in Table 1, the longitudinal crack at the center in the width direction of the long side of the steel piece was observed, and no crack was observed under the conditions of Invention Examples A2 to A5 in which the molten steel flow rate of 20 cm/sec or more could be provided. Therefore, uniform solidification could be achieved on the long side surface by provision of the flow rate of 20 cm/sec or more and, more preferably, provision of the molten steel flow rate of about 30 cm/sec.

TABLE 1

| | Electromagnetic stirring frequency f (Hz) | Long side wall thickness $D_{Cu}$ (mm) | Skin depth of mold Right side of formula (1)-a (mm) | Skin depth of molten steel electromagnetic force Left side of formula (1)-b (mm) | Stirring flow rate (cm/s) |
|---|---|---|---|---|---|
| Comparative Example A1 | 4 | 25 | 58 | 156 | 18 |
| Invention Example A2 | 8 | 25 | 41 | 110 | 22 |
| Invention Example A3 | 10 | 25 | 37 | 99 | 30 |
| Invention Example A4 | 12 | 25 | 33 | 90 | 32 |
| Invention Example A5 | 16 | 25 | 29 | 78 | 30 |
| Comparative Example A6 | 20 | 30 | 26 | 70 | 15 |

Next, under the conditions described above, several molds with different shapes (curved shapes) of the short side walls were prepared, and similarly using the continuous casting facility equipped with the EMS on the back side of the long side wall, casting was performed under a condition that the stirring flow was formed by the EMS so as to swirl at a stirring flow rate of about 30 cm/sec in the horizontal cross section near the meniscus. The EMS was installed so that the upper end of the core coincided with the meniscus position P1. The core thickness of the EMS is 200 mm, and the lower end 16 of the electromagnetic stirring device is 200 mm apart from the meniscus position P1. Casting was performed so that the position of the bath level in the mold coincided with the meniscus position P1. The immersion depth 17 (distance from the meniscus position P1) of the immersion nozzle was 250 mm, and the casting speed was 4 m/min.

Figure 10:
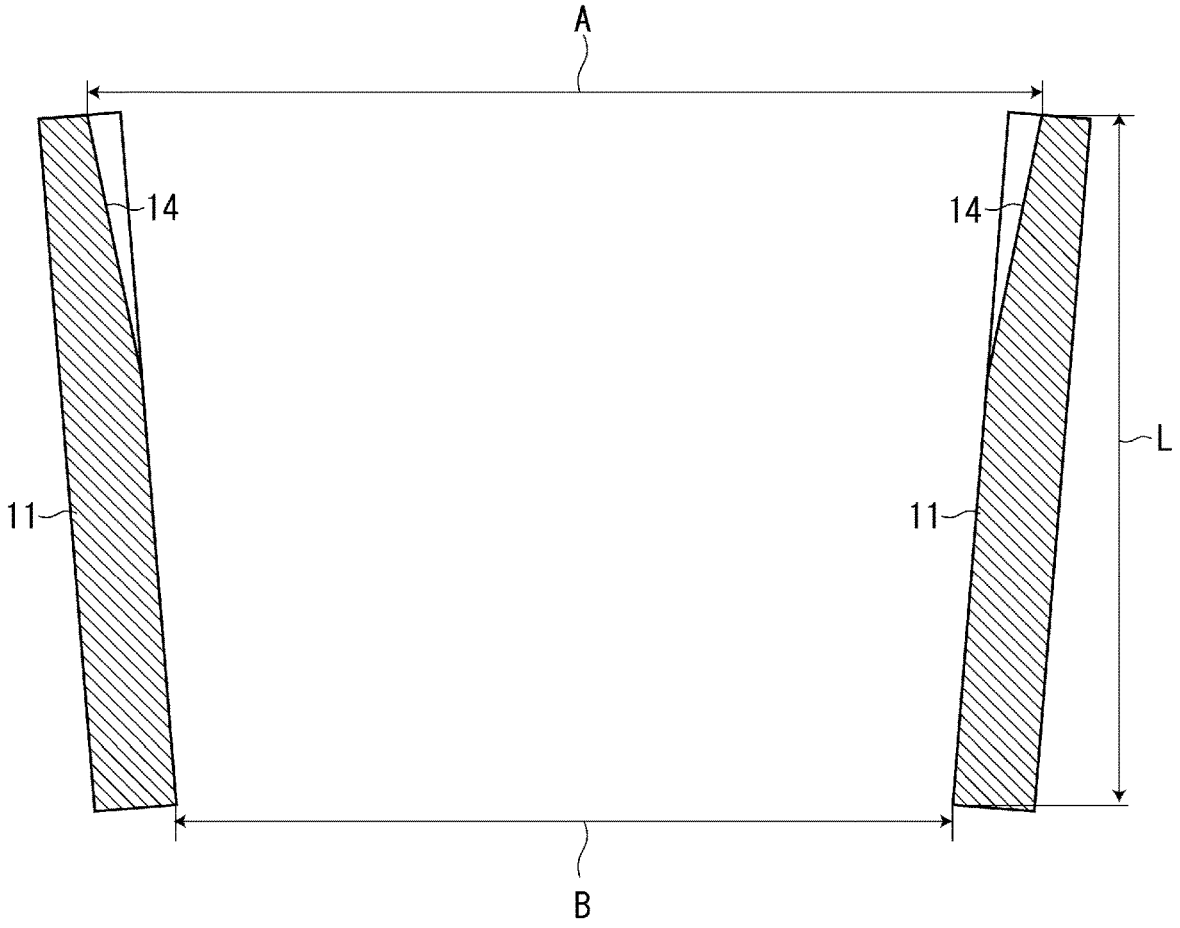
FIG. 10 is a diagram illustrating a short side taper.

The taper of the short side wall was 1.4%/m. Here, in the taper of the short side wall, as shown in FIG. 10, when the short side wall is viewed in a plan view, in a distance between the inner surfaces (steel piece contact surfaces) (when there is a recess, a deepest portion of the recess) of the short side walls on both sides, the taper is a value obtained by dividing a difference between a distance A at the upper end of the mold and a distance B at the lower end of the mold by a length L in the vertical direction (casting direction) of the short side wall, and expressed in %. That is, taper (%)=(A−B)/L×100.

Regarding the slab cast under the above conditions, the C-section solidification structure of the steel piece was investigated.

Similar to the above-described FIG. 6, for the white band 21 (see FIG. 5) observed by portraying the solidification structure by etching, in the region toward the width center from the corner 26 on the long side 23 side of the steel piece, a ratio of the thickness A of the site where the thickness from the surface to the white band was substantially constant and the thickness B of the thinnest portion of the center of the short-side thickness, that is, B/A was defined as solidification uniformity. The solidification uniformity of 0.7 or more was evaluated as favorable.

In addition, it was investigated whether the crack under the skin was observed in the solidification delay portion. The method of evaluating the crack under the skin is as described above.

At the same time, the mold resistance was also investigated. For the mold resistance, the oscillation current was measured, and when the measured oscillation current was smaller than the oscillation current value when sticking breakout occurred, the mold resistance was evaluated as "small", and when the measured oscillation current was equal to or more than the oscillation current value when sticking breakout occurred, the mold resistance was evaluated as "large".

Table 2 shows test conditions and results.

TABLE 2

| | | Short side wall curved shape | | | | Quality evaluation result | | |
|---|---|---|---|---|---|---|---|---|
| No. | Electromagnetic stirring | Projecting amount δ (mm) | δ/T (—) | Lower end position P2 (from P1) (mm) | Casting state Resistance | Solidification uniformity (—) | Crack under the skin | Long side longitudinal crack |
| Invention Example 1 | With | | No curve | | Small | 0.60 | Presence | Absence |
| Invention Example 2 | With | 1.8 | 0.012 | 200 | Small | 0.70 | Absence | Absence |
| Invention Example 3 | With | 7.5 | 0.050 | 200 | Small | 0.72 | Absence | Absence |
| Invention Example 4 | With | 14 | 0.093 | 200 | Small | 0.75 | Absence | Absence |
| Invention Example 5 | With | 18 | 0.120 | 200 | Large | 0.69 | Restricted | Absence |
| Invention Example 6 | With | 1 | 0.007 | 200 | Small | 0.66 | A few present | Absence |
| Invention Example 7 | With | 4.5 | 0.030 | 100 | Small | 0.63 | Presence | Absence |
| Invention Example 8 | With | 4.5 | 0.030 | 400 | Small | 0.64 | Presence | Absence |
| Invention Example 9 | With | 6 | 0.040 | 500 | Small | 0.65 | Presence | Absence |
| Invention Example 10 | With | 2 | 0.013 | 400 | Small | 0.61 | Presence | Absence |
| Comparative Example 1 | Without | | No curve | | Small | 0.20 | Presence | Presence |

Each of Invention Examples 2 to 4 shown in Table 2 shows a result obtained when the lower end of the formation range of the curved shape of the short side wall was unified from the meniscus position P1 to 200 mm (=the same position as the lower end of the electromagnetic stirring device) and δ/T was 0.012, 0.05, or 0.093 within the preferable range (0.01 to 0.1); however, the solidification uniformity of 0.7 or more was obtained in all cases without increasing the mold resistance, and significant improvement was obtained. Since the solidification uniformity was improved, no solidification delay portion was observed, and no crack under the skin was observed. On the other hand, in Invention Example 1, although under the condition that no projecting was provided, the solidification uniformity showed a low value as compared with Invention Examples 2 to 4. However, as compared with the solidification uniformity in Comparative Example 1 in which electromagnetic stirring described below was not performed, the solidification uniformity was significantly improved, and although cracks under the skin were found in some cases, they were not at a level that hindered commercialization. In all of Invention Examples 1 to 4, no longitudinal crack was observed at a center of the long side surface of the steel piece.

Invention Example 5 is a condition that 6/T is 0.12, which is more than the upper limit value of the preferable range, although the projecting is provided. In this case, although the solidification uniformity was relatively good, the resistance value locally increased, and there were surface properties as partially restricted. Invention Example 6 is a condition that 6/T is 0.007, which is less than the lower limit of the preferable range, although the projecting is provided. In this case, the solidification uniformity was 0.66, which was better than the solidification uniformity of Invention Example 1 without a curve; however, small cracks under the skin were scattered.

In Invention Example 7, a projecting was provided, and δ/T was 0.03 within the preferable range; however, the formation range of the projecting was shorter than the core thickness of the EMS, so that the value of the solidification uniformity was lower than that in Invention Examples 2 to 4. Invention Example 8 shows a result obtained when a projecting is provided, δ/T is 0.03 within the preferable range, and the formation range of the projecting is 0.4 m, which is equal to or more than the core thickness of the EMS and equal to or more than the immersion depth of the immersion nozzle. In this case, the effect of improving the solidification uniformity was small as compared with Invention Examples 2 to 4. In addition, a crack under the skin due to the solidification delay portion was also observed. In Invention Example 9, a projecting was provided, and δ/T was 0.04 within the preferable range; however, since the formation range of the projecting was 0.5 m, which was equal to or more than the immersion depth of the immersion nozzle, the effect of improving the solidification uniformity was small as compared with Invention Examples 2 to 4. In addition, a crack under the skin due to the solidification delay portion was also observed. In Invention Example 10, a projecting was provided, and δ/T was 0.013 within the preferable range; however, since the formation range of the projecting was 0.4 m, which was equal to or more than the immersion depth of the immersion nozzle, the effect of improving the solidification uniformity was small as compared with Invention Examples 2 to 4. In addition, a crack under the skin due to the solidification delay portion was also observed. In all of Invention Examples 7 to 10, no longitudinal crack was observed at the center of the long side surface of the steel piece.

In contrast, Comparative Example 1 does not perform electromagnetic stirring in the mold and does not have a curved shape of the short side wall. The solidification uniformity was only 0.2, which was a level at which there was a risk of casting interruption (breakout). Since no swirl flow was formed, a large longitudinal crack occurred at the width center of the long side of the steel piece.

From the above, by using the continuous casting facility for steel of the present disclosure, it is possible to form a swirl flow in the horizontal cross section near the meniscus of molten steel in the mold, and in a further preferable condition, it has been confirmed that when the swirl flow is formed, uniform solidification on the short side wall side of the mold can be achieved.

In the above, the present disclosure has been described referring to the embodiment. However, it is to be understood that the disclosure is not limited to the embodiment but includes other embodiments and modifications without departing from the scope as set out in the accompanying claims. For example, continuous casting facilities for steel, obtained by combining all or part of the embodiment and all or part of such modifications, are therefore construed to be within the scope of the disclosure.

In the above embodiment, the maximum value of the projecting amount δ is set to be the thickness central portion of the short side wall. However, for example, depending on the size and configuration of the mold, the maximum value can be shifted from the thickness central portion to the corner side.

Although the curved projecting is formed in the range from the upper end of the short side wall to the position P2 below the lower end of the EMS and above the immersion depth of the immersion nozzle, the formation range is not particularly limited as long as the projecting is formed from at least the meniscus position P1 in the casting direction.

FIELD OF INDUSTRIAL APPLICATION

According to the present disclosure, it is possible to achieve uniform solidification while providing a swirl flow near the bath level in the mold.

BRIEF DESCRIPTION OF THE REFERENCE SYMBOLS

1 Electromagnetic stirring device
2 Immersion nozzle
3 Discharge hole
4 Nozzle discharge flow
5 Casting space
6 Molten steel
7 Molten steel surface
8 Thrust
9 Swirl flow
10, 11 Short side wall
12 Mold
14 Recess
15 Long side wall
16 Lower end of electromagnetic stirring device
17 Immersion depth of immersion nozzle
18 Powder layer
19 Solidified shell
20 Solidification delay portion
21 White band
22 Steel piece
23 Long side
24 Short side
25 Surface
26 Corner
27 Thickness center
P1 Meniscus position
P2 Curved shape lower end position
δ Projecting amount
T Steel piece thickness in mold

What is claimed is:

1. A continuous casting facility used for thin slab casting for steel in which a steel piece thickness in a mold is 150 mm or less and a casting width is 2 m or less, the continuous casting facility comprising:

a mold for casting molten steel that includes a pair of long side walls and a pair of short side walls that are each formed from a copper plate and are arranged opposite to each other;

an immersion nozzle that supplies the molten steel into the mold; and an electromagnetic stirring device that is disposed entirely along the long side wall on a back side of the pair of long side walls and provides a swirl flow on a molten steel surface in the mold, wherein a thickness $D_{Cu}$ (mm) of the copper plate of the long side wall, a thickness T (mm) of the steel piece, a frequency f (Hz) of the electromagnetic stirring device, electric conductivity σ (S/m) of the molten steel, and electric conductivity $\sigma_{Cu}$ (S/m) of the copper plate of the long side wall are adjusted to satisfy the following formulae (1)-a and (1)-b:

$$D_{Cu}<\sqrt{(2/\sigma_{Cu}\omega\mu)} \quad (1)\text{-a}$$

$$\sqrt{(1/2\sigma\omega\mu)}<T \quad (1)\text{-b},$$

wherein $\omega=2\pi f$: angular velocity (rad/sec), and $\mu=4\pi\times10^{-7}$: magnetic permeability in vacuum ($N/A^2$), and wherein a plane cross-sectional shape of an inner surface of the short side wall is a curved shape projecting outside the mold at a meniscus position which is a position 100 mm below an upper end of the mold, and is a flat shape at a lower portion in the mold while a projecting amount of the curved shape gradually decreases toward a lower side in a casting direction, a formation range of the curved shape is a range from the meniscus position to a position equal to or lower than a lower end of the electromagnetic stirring device and upper than an immersion depth of the immersion nozzle, and a projecting amount δ (mm) at the meniscus position of the curved shape and a thickness T (mm) of the steel piece cast by the mold satisfy a relationship of the following formula (2):

$$0.05\leq\delta/T\leq0.1 \quad (2).$$

2. A continuous casting method for steel using a continuous casting facility for steel in which a steel piece thickness in a mold is 150 mm or less and a casting width is 2 m or less, the continuous casting facility comprising:

a mold for casting molten steel that includes a pair of long side walls and a pair of short side walls that are each formed from a copper plate and are arranged opposite to each other;

an immersion nozzle that supplies the molten steel into the mold; and an electromagnetic stirring device that is disposed entirely along the long side wall on a back side of the pair of long side walls and provides a swirl flow on a molten steel surface in the mold, wherein a plane cross-sectional shape of an inner surface of the short side wall is a curved shape projecting outside the mold at a meniscus position which is a position 100 mm below an upper end of the mold, and is a flat shape at a lower portion in the mold while a projecting amount of the curved shape gradually decreases toward a lower side in a casting direction, a formation range of the curved shape is a range from the meniscus position to a position equal to or lower than a lower end of the electromagnetic stirring device and upper than an immersion depth of the immersion nozzle, and a projecting amount δ (mm) at the meniscus position of the curved shape and a thickness T (mm) of the steel piece cast by the mold satisfy a relationship of the following formula (2):

$$0.05\leq\delta/T\leq0.1 \quad (2),$$

the continuous casting method comprising:

adjusting a thickness $D_{Cu}$ (mm) of the copper plate, a thickness T (mm) of the steel piece, a frequency f (Hz) of the electromagnetic stirring device, electric conductivity σ (S/m) of the molten steel, and electric conductivity $\sigma_{Cu}$ (S/m) of the copper plate to satisfy the following formulae (1)-a and (1)-b:

$$D_{Cu}<\sqrt{(2/\sigma_{Cu}\omega\mu)} \quad (1)\text{-a}$$

$$\sqrt{(1/2\sigma\omega\mu)}<T \quad (1)\text{-b},$$

wherein $\omega=2\pi f$: angular velocity (rad/sec), and μ: magnetic permeability in vacuum ($N/A^2$).

* * * * *